US008105075B2

(12) United States Patent
Huau

(10) Patent No.: US 8,105,075 B2
(45) Date of Patent: Jan. 31, 2012

(54) HOLLOW FLAME VERSATILE BURNER FOR HYDROCARBONS

(76) Inventor: Christian Bernard Huau, Fontenay-Aux-Roses (FR)

( * ) Notice: Subject to any disclaimer, the term of this patent is extended or adjusted under 35 U.S.C. 154(b) by 556 days.

(21) Appl. No.: 12/225,524

(22) PCT Filed: Mar. 29, 2007

(86) PCT No.: PCT/FR2007/000539

§ 371 (c)(1),
(2), (4) Date: Sep. 24, 2008

(87) PCT Pub. No.: WO2007/118971

PCT Pub. Date: Oct. 25, 2007

(65) Prior Publication Data

US 2009/0253088 A1 Oct. 8, 2009

(30) Foreign Application Priority Data

Mar. 31, 2006 (FR) ..... 06 02806

(51) Int. Cl.
*F23C 5/06* (2006.01)

(52) U.S. Cl. ..... 431/186; 431/189; 431/8; 239/401

(58) Field of Classification Search ..... 431/8, 186, 431/189; 239/401

See application file for complete search history.

(56) References Cited

U.S. PATENT DOCUMENTS

| | | | | | |
|---|---|---|---|---|---|
| 1,713,259 | A | * | 5/1929 | Chandler | 239/422 |
| 1,713,260 | A | * | 5/1929 | Chandler | 239/413 |
| 2,063,396 | A | * | 12/1936 | Parrigin | 239/434.5 |
| 3,123,127 | A | * | 3/1964 | Willott | 431/186 |
| 3,256,842 | A | * | 6/1966 | Vigneron et al. | 431/46 |
| 3,663,153 | A | * | 5/1972 | Bagge et al. | 431/351 |
| 3,782,884 | A | * | 1/1974 | Shumaker | 431/186 |
| 4,155,702 | A | * | 5/1979 | Miller et al. | 431/353 |
| 4,452,583 | A | | 6/1984 | Brooks | |
| 4,655,706 | A | | 4/1987 | Bayh | |
| 4,951,581 | A | * | 8/1990 | Wiest | 110/262 |
| 5,044,558 | A | | 9/1991 | Young | |
| 5,058,808 | A | | 10/1991 | Young | |
| 5,573,394 | A | * | 11/1996 | Pershina | 431/258 |
| 5,993,196 | A | | 11/1999 | Young | |
| 6,027,332 | A | | 2/2000 | Glotin | |

FOREIGN PATENT DOCUMENTS

| | | |
|---|---|---|
| DE | 21 06 448 | 1/1972 |
| EP | 0 410 562 | 1/1991 |
| FR | 2 498 301 | 7/1982 |
| FR | 2 741 424 | 5/1997 |

* cited by examiner

*Primary Examiner* — Kenneth Rinehart
*Assistant Examiner* — Jorge Pereiro

(57) ABSTRACT

To enable a significant flow of liquid, gas or mixed hydrocarbons to be eliminated cleanly and safely, particularly during a well test phase, a burner comprises two concentric apertures, rotationally symmetrical about a common axis, enabling a hollow flame to be generated. The central aperture (20), intended for liquid or mixed products supplied by a conduit (12), consists of 2 concentric male (22) and female (21) conical parts, with the spacing (25) therebetween being continuously adjusted by the axial movement of the rod (23) which carries the male component (22) and which is centered by a centring component (24) in the conduit pipe (12), which carries the female component (21). The peripheral aperture (60), intended for gas products or an auxiliary airflow, also consists of two concentric male (62) and female (61) conical parts, between which the spacing (65) is not necessarily continuously variable during burning.

4 Claims, 3 Drawing Sheets

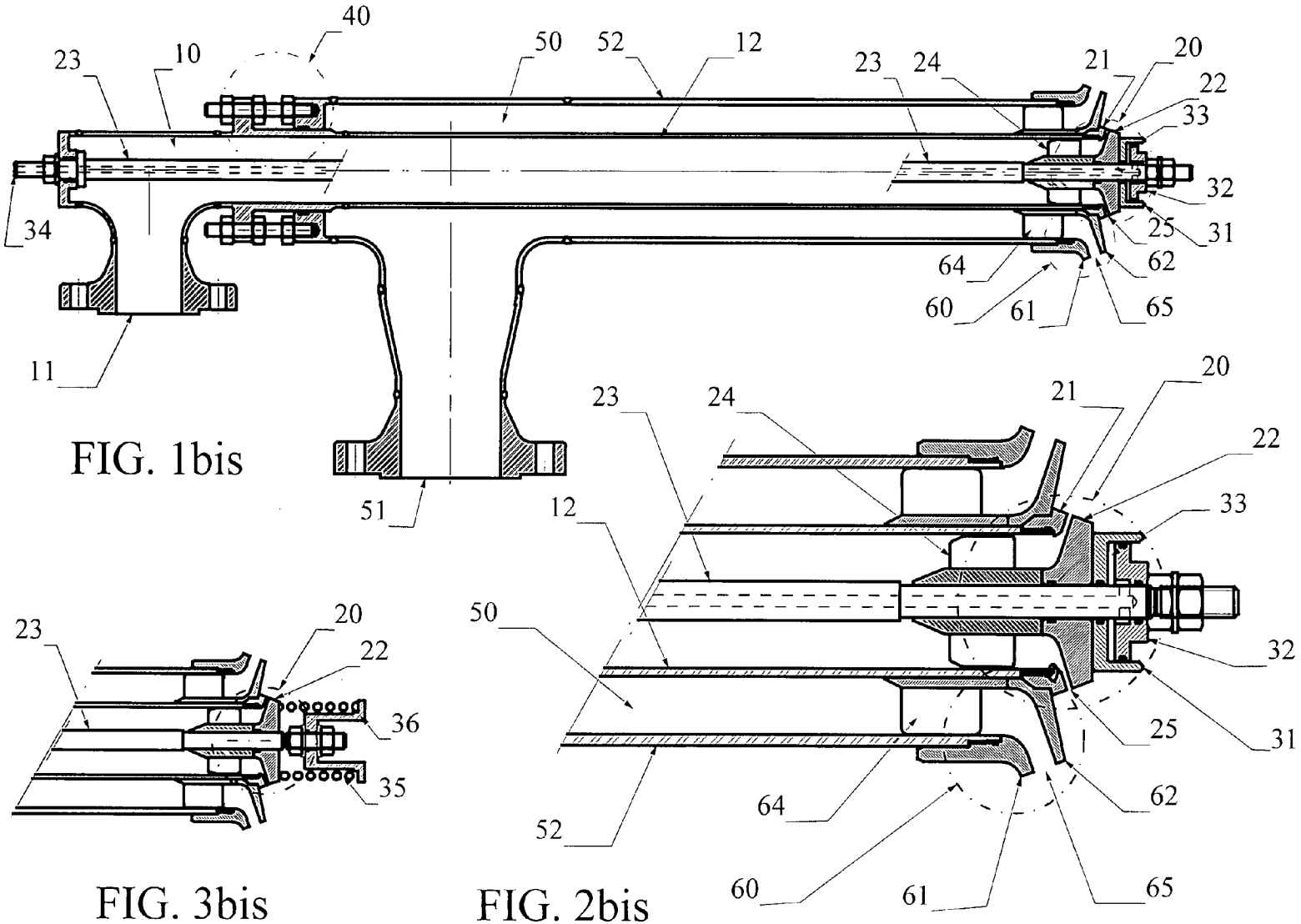
FIG. 1bis
FIG. 2bis
FIG. 3bis

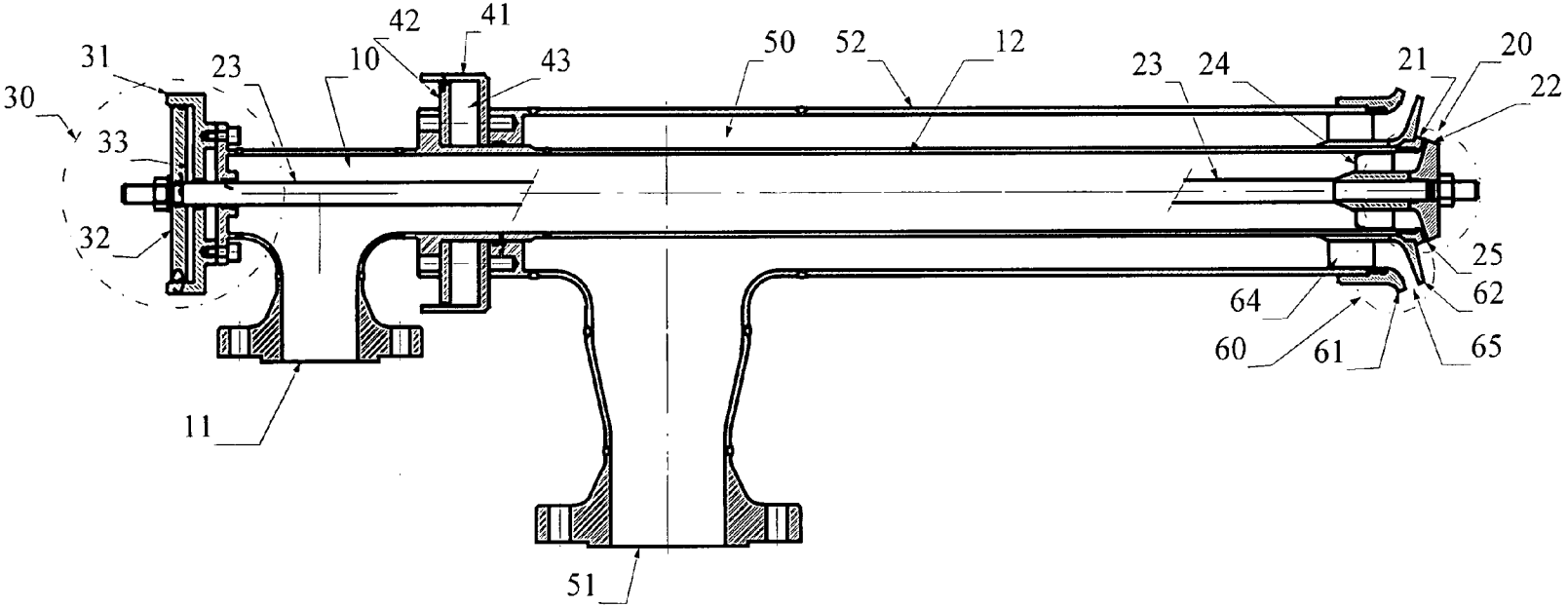
FIG. 4
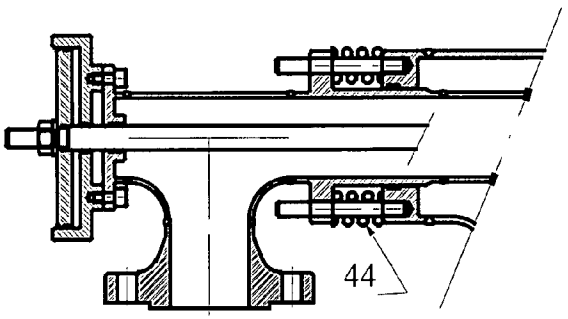
FIG. 4bis

HOLLOW FLAME VERSATILE BURNER FOR HYDROCARBONS

TECHNICAL FIELD

In the exploitation of the petroleum fields, it is sometimes necessary to dispose of large quantities of liquid or gas hydrocarbons.

Indeed, once a well aimed to the production of hydrocarbons is completed, its production capability must be measured by an operation called "well testing", during which the quantity of hydrocarbons really produced is measured, as well as the physical state (pressure, temperature, gas/liquid ratio . . . ) of these hydrocarbons.

The hydrocarbons produced during this test must be disposed of, but, at this stage, there is not yet evacuation means for production. Due to the quantity of produced hydrocarbons, a temporary storage is difficult and moreover hazardous, particularly for offshore installations. Furthermore the storage does not solve the problem of the later evacuation.

Consequently, the technique used since the development of offshore oil prospecting is the burning of these hydrocarbons, directly during the testing operation, once the measurements are done.

Up to now, the measurements done on the hydrocarbon flow require the separation of the gas from the liquid products. The burning is then made by 2 different devices, called "flare" for the gas and "burner" for the liquid, because the techniques of burning are very different.

For some time, new measurement devices, so-called "multi-phasic", which no longer require the separation of gas and liquid, are coming. Up to now, separation remains necessary for the burning, what makes to lose a lot of interest in those new systems of measurement.

Furthermore, the burning of liquid remains difficult and not yet well solved.

The present invention is a new burner with improved burning techniques, compared to the techniques presently used for on-site burning of liquid hydrocarbons, and allowing either the burning of non separated hydrocarbons, or the simultaneous burning of separated hydrocarbons.

BACKGROUND ART

The combustion of 1 kilogram of hydrocarbon requires approximately 3 kg of oxygen that means approximately 15 kg of air. Whatever is the technique, the key point of the burning is the mixing of the hydrocarbon with the huge quantity of air needed for the combustion.

In the case of gas, the mixture with air is rather easy to realize because the densities of both products are not very different.

In the case of liquid hydrocarbons, which have densities in the 700 to 950 kg/m3 range, the 15-to-1 air-to-hydrocarbon mass ratio means a minimum 10 000-to-1 volume ratio. With such a ratio, obtaining a mixture allowing a good combustion is difficult. All the developments of oil burner, made for several decades, had for objective the resolution of this problem.

In order to obtain a homogeneous mixture of liquid and air with such a volume ratio, it is necessary to split up the liquid in droplets (atomization) and to distribute these droplets homogeneously in the volume of air.

Moreover, the flowrate of liquid hydrocarbon to burn is at least 10 000 barrels a day or approximately 20 liters per second. The volume of air necessary for the combustion is then at least 200 $m^3$ per second. The thermal power developed by the combustion of such an oil flowrate is roughly 600 megawatts.

A closed burner capable of burning such a flowrate would have a size, a weight and a cost unacceptable for an offshore installation, especially to be operated only during a few hours or days. Consequently, all the known burners work with free flames and are installed at the end of long booms to take the flames away from the platform, in order both to reduce the fire hazard and to decrease the thermal radiation of the flames towards the platform.

Existing burners use the pneumatic atomization which consists in breaking the liquid in droplets by injection of a strong compressed air flow in the liquid stream. The air-droplets mixture is then ejected in the atmosphere through an outlet.

With this technique, it is possible, through a constant size outlet, to change the air flowrate, by changing its pressure, and then to change the oil flowrate: by experience, it is possible to vary the oil flowrate in a 1 to 5 range.

This technique generates a strong air jet which, by friction in the atmosphere, absorbs a large quantity of atmospheric air, necessary for the combustion (phenomenon of ingestion).

Nevertheless, the quantity of oil which can be burnt in one single jet of compressed air remains low (by experience, around 2 liters per second) because physics limit the shape of the air jet to a narrow (around 15° angle) and short (around 7 meters) cone. Its contact area with the atmosphere remains small.

In such a conical air jet, if the flowrate of liquid is higher than 2 liters per second, the beginning of the flame is too rich with regard to the quantity of available air; the combustion is very incomplete, producing a lot of carbon and heavy unburnt products. The experience shows that a part of these products will burn later in the following part of the flame which continues to absorb atmospheric air, but another part will never burn, generating a thick black smoke and fall-out of unburnt hydrocarbons.

A technique used for several decades against this smoke (U.S. Pat. No. 3,894,831) consists in injecting a large quantity of water in the beginning of the flame, what gets rid of the smoke. Indeed, by cooling the beginning of the flame, the water slows down the phenomenon of evaporation of the droplets of oil, decreasing the apparent richness in the beginning of the flame. In a sense, the water allows a part of the droplets to pass thru the beginning of the flame and to go farther to burn. Unfortunately, a part of this liquid will never evaporate, or too late to burn, and will fall on the ground or at the sea, immediately or by later condensation of unburnt vapours contained in the flue gases.

A more recent solution (patent FR2741424, U.S. Pat. No. 6,027,332) consists in increasing strongly the air-to-liquid mass ratio in the burner, up to 18%. This reduces the richness of the jet and thus of the flame, with same air ingestion. The injection of water becomes unnecessary and the combustion is better, but the quantity of hydrocarbon burnt by one jet comes back to the 2 liters per second limit, what makes necessary a large number of jets: some ten flames, thus so many jets are necessary for the wanted flowrate.

That patent (FR2741424, . . . ) arranges twelve jets distributed following the shape of a wide cone around a unique point of distribution of the fluids.

Another patent (U.S. Pat. No. 5,993,196) arranges three groups of three jets from a structure of distribution of the fluids, the jets being arranged to distribute the nine flames in the largest possible volume.

Besides the cost of the compressed air (cost of compressors, occupied room, piping), the number of jets makes the burner complex and its maintenance expensive.

Moreover its range of flowrate remains narrow (1 to 5) except if it is possible to open selectively the outlets, what still increases the complexity of the system.

At last, the mixture of hydrocarbons and air inside the burner remains a safety issue.

DISCLOSURE OF INVENTION

The present invention concerns a burner for liquid or gas hydrocarbons, separated or not, intended for the fast and clean disposal of hydrocarbons produced on oil installations, in land or offshore.

This invention is based on the use of a unique large hollow flame realized by the mean of a unique main spreader with real-time continuously variable aperture, assisted by a secondary concentric spreader with adjustable or variable aperture, accordingly to the conditions of service.

The main, or central, spreader with real-time continuously variable aperture is placed at the end of a pipe by which either the liquid hydrocarbons, or the mixed (not separated) liquid and gas, are brought. This spreader is an annular outlet which consists in the spacing between two mechanical parts, both of conical shape with a wide angle, the one female (concave), the other male (convex), placed one in the other along the same axis.

In a preferred embodiment, the female part is static and fixed directly at the end of the pipe by mechanical means such as this female part can be easily removed and changed, either because of the wear due to hydrocarbons, or in order to change its geometrical characteristics accordingly to the conditions of operation. The male part is placed inside the female part, fixed on an axial support, by mechanical means such as this male part can also be easily removed and changed. That support is not only able to maintain the male part centered in the female part but also to give it an axial motion so as to make vary continuously the spacing between the male and female parts. The outlet can thus change its aperture from the closed position to the maximal aperture accordingly to the flowrate and to the characteristics of the fluid.

This annular outlet allows the mechanical atomization of liquid hydrocarbons and the spreading of the droplets along the surface of a cone with an angle similar to the angle of both conical parts. This geometry of spreading of the droplets aims at placing these droplets in contact with the atmospheric air on the largest possible area from a unique point of exit, so that those droplets of hydrocarbon can find as fast as possible the air they need for combustion. Theoretically, the best geometry would be a disk (cone with a 180° large angle) but, for practical considerations, a very wide cone (less than 180°) is preferred. Indeed, a flat flame with a disk shape, placed with a horizontal axis at the end of a boom on an offshore platform would turn back quickly towards the structures in case of small front wind. Moreover, the thermal radiation received by the platform would be maximal. Furthermore, in case of side wind, the flame would be pushed on the burner, with destructive effects. The invention allows the use of spreaders with angle chosen accordingly to the best compromise between the largest flame area (largest angles) and the largest distance to the structures (smallest angles).

The mechanical atomization generated by the outlet requires hydrocarbons with a few bar pressure, what is not higher than the back pressure of existing burners. Furthermore, the liquid hydrocarbons almost always contain some gas because the gas-liquid separation is made in a limited time and under a few bar pressure, what prevents a perfect separation. When arriving at the level of the outlet, this gas is depressurized at the atmospheric pressure and produces a pneumatic help to the atomization and to the ejection of the droplets.

If the hydrocarbons contain a large quantity of gas (not separated), this phenomenon becomes dominating and the aperture of the outlet is then much larger because the volumetric flowrate, mainly due to the gas, is much higher.

The size of the droplets obtained by the mechanical atomization depends mainly on the viscosity of the liquid and on the size of the aperture of the outlet. This aperture is continuously adjusted during the burning and depends mainly on the hydrocarbon flowrate. As a result, the droplets are bigger when the flowrate is higher. This constitutes a particularly important characteristic and a property of this burner.

Indeed, when droplets are thrown in the atmosphere, the distance they cover depends mainly on their size, the density being little variable. Consequently, when the flowrate increases, all the following parameters increase too: the aperture of the outlet, the size of the droplets, the distance they cover, the volume of distribution, the contact area with the atmosphere. Thus, we obtain naturally a larger flame, always well aerated, when the flowrate is higher.

Furthermore, such an outlet does not create a single size of droplets but a distribution of sizes. Droplets are then distributed along the flame accordingly to their size and so feed the various sections of the flame.

Nevertheless, this device cannot answer alone to all the cases. Particularly when the conditions' create a large quantity of very small droplets which cannot be ejected far enough by purely mechanical means and which are strongly diverted by the wind. It is notably the case with very light liquids in weak flowrate.

Moreover the burner must be able to burn simultaneously the separated gas, if any.

The main annular outlet described here above is thus associated to a concentric secondary annular outlet, which consists in the spacing between two mechanical parts, both of conical shape with substantially the same cone angle as the cone angle of the main outlet's one, the female part having a concave internal surface, the male part having a convex external surface and being placed inside the female part along the same axis.

This secondary, or peripheral, outlet is intended for a gas flow (air or hydrocarbon) and then its aperture does not necessarily require to be continuously variable during the burning. In a preferred embodiment, the conduit bringing the gas flow to the secondary outlet is constituted by the annular space between the previously described pipe for liquid and a larger pipe placed around that previous pipe. The female part of the secondary outlet is then fixed directly to that outer pipe, by mechanical means such as it can easily be removed and changed, and the male part is fixed at the end of the previous pipe for liquid, at the back of the female part of the main outlet, by similar means. The conduit pipe for liquid is maintained centered inside the outer pipe with a capability of axial motion which allows to make vary the spacing between the male and female parts of the secondary outlet, thus its aperture.

This secondary annular outlet is intended to receive the separated gas, if any, or, if not, a flow of compressed air. In both cases, the hollow conical gas jet produced by this outlet realizes a pneumatic carrying of the smallest droplets of liquid, produced by the main outlet, towards the hollow conical flame. By this mean, the smallest droplets cannot escape in case of side wind and the beginning of the flame is pushed away from the burner. Furthermore, this secondary outlet allows the gas flaring.

A second important characteristic of this burner is that, by associating the mechanical atomization of the liquid hydrocarbon and the pneumatic carrying by the associated gas, separated or not, the operation is optimized in every case. Indeed, heavy hydrocarbons contain few gases but generate large droplets which evaporate slowly and require a little pneumatic carrying. On the contrary, light hydrocarbons contain a lot of gases and generate small droplets which evaporate fast and require a strong pneumatic carrying, given by the large quantity of gas.

BRIEF DESCRIPTION OF THE DRAWINGS

We now describe, as non-limitative examples, several embodiments of the invention with reference to the drawings in which:

FIG. 1 *bis* is a view following a longitudinal section of another embodiment of the invention;

FIG. 2 *bis* is a detailed view of the outlets of the apparatus shown by FIG. 1 *bis;*

FIG. 3 *bis* is a detailed view of a simplified embodiment of the apparatus shown by FIG. 1 *bis;*

FIG. 4 is a view following a longitudinal section of a more complex embodiment of the invention, including an extra gas control function;

FIG. 4 *bis* shows another embodiment of the invention, including an extra gas control function.

BEST MODE FOR CARRYING OUT THE INVENTION

Figure 1:
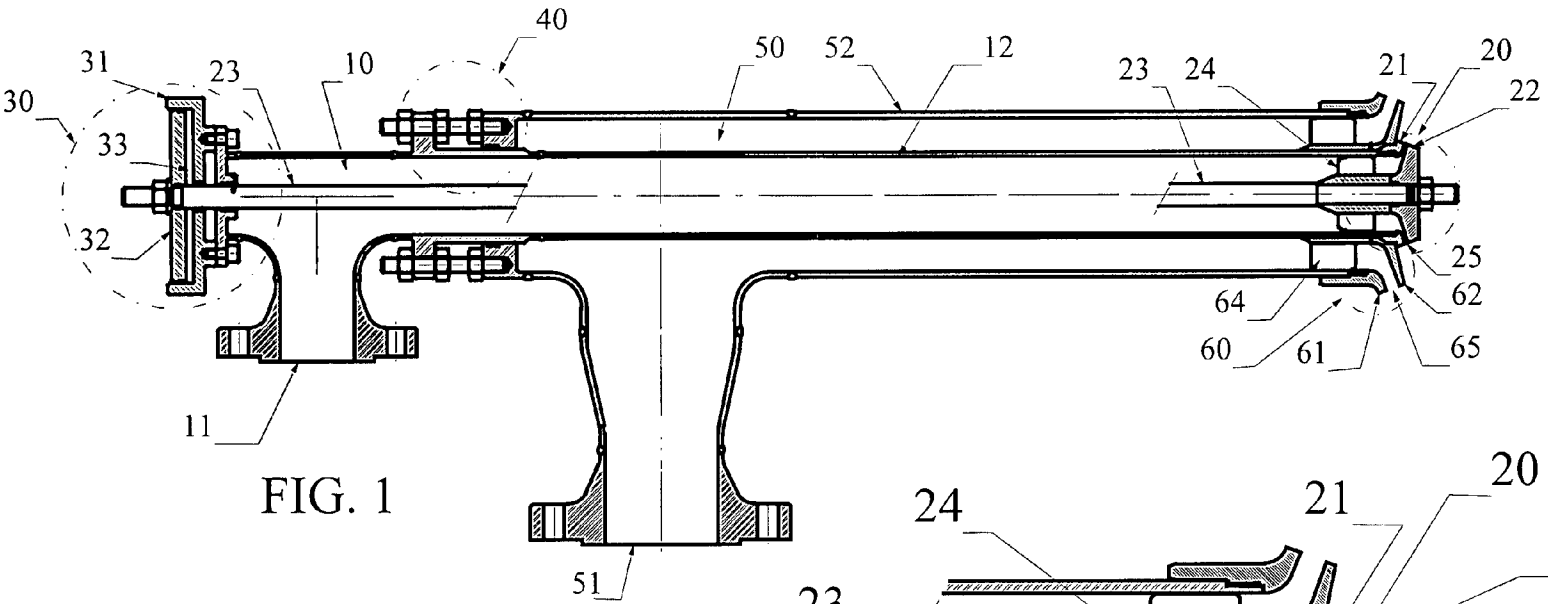
FIG. 1 is a view following a longitudinal section of a preferred embodiment of the invention.

On FIG. 1 is represented the preferred embodiment of the invention, which includes a central flowline (10) intended to bring the flow of liquid or mixed (non-separated gas and liquid) hydrocarbons to the main central outlet (20). This flowline is constituted by a conduit pipe (12) and has a lateral inlet (11) to receive the flow. This inlet must be connected to an external flowline, not shown on the drawing, coming from the source of the flow.

Along the axis of the flowline (10) is placed the rod (23) which is intended to carry and control the male part (22) of the central outlet (20). At the back of the flowline (10) is placed the device (30) which gives the axial motion of the rod (23), indeed a piston (32) and cylinder (31) assembly which realizes a closed volume (33) inside which a pressurized fluid is injected, through a flowline, not shown here. That axial motion of the rod (23) allows the continuous adjustment of the aperture (25) of the central outlet (20) during operation.

At the front end of the pipe (12) is fixed the female part (21) of the central outlet (20). At the front end of the rod (23) are fixed the centring part (24) which maintains this rod on the axis of the pipe (12), and the male part (22) of the central outlet (20). This centring part (24) allows the axial motion of the rod (23) along the axis of the pipe (12).

The preferred embodiment of the invention also includes, around the central flowline (10) for liquid or mixed hydrocarbons, a peripheral flowline (50) for gas hydrocarbon if any, or for assisting air flow. This peripheral flowline (50) is made from an outer pipe (52) and has an inlet (51) for the gas flow, which must be connected by an external flowline, not shown here, to the source of that flow.

At the front end of this outer pipe (52) is fixed the female part (61) of the peripheral outlet (60). At the front end of the central pipe (12) are fixed the centring part (64) which maintains this pipe (12) on the axis of the outer pipe (52), and the male part (62) of the peripheral outlet (60). This centring part (64) allows the axial motion of the central pipe (12) along the axis of the outer pipe (52). At the back of the peripheral flowline (50) is placed the device (40), in this case a nut-screw assembly, which gives the motion of the central pipe (12) in order to adjust the aperture (65) of the peripheral outlet (60).

In that preferred embodiment of the invention, the apparatus, will be fixed and carried by the flange of the inlet (51) of the peripheral flowline, the whole apparatus being designed accordingly. By a consequence, the end of the external flowline for the gas flow will also be designed for that purpose. Furthermore the external flowline for the liquid (or mixed) flow will be designed with the capability to accept, at the level of the device (40), the motion for the adjustment of the aperture (65) of the peripheral outlet (60).

Figure 2:
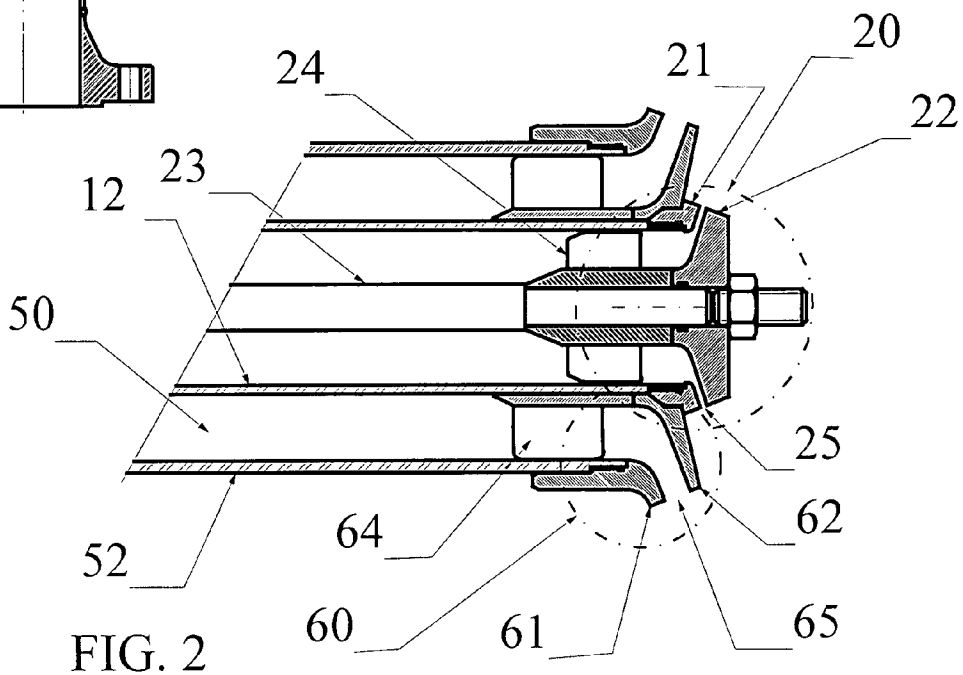
FIG. 2 is a detailed view of the outlets of the apparatus shown by FIG. 1.

FIG. 2 is a detailed view of both the outlets and the front end of the flowlines, in the preferred embodiment of the invention, shown by FIG. 1.

ALTERNATIVE MODES FOR CARRYING OUT THE INVENTION

Figure 3:
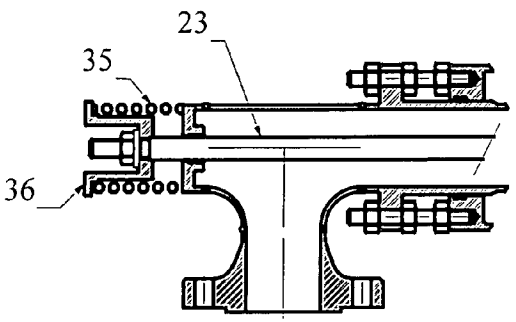
FIG. 3 is a detailed view of a simplified embodiment of the invention.

FIG. 3 shows a simplified embodiment of the invention, in which the adjustable aperture (25) of the central outlet (20) is controlled by a simple spring (35) applying a traction on the rod (23) by a plate (36). In this simplified embodiment, the aperture (25) of the central outlet (20) is linked to the pressure of the liquid (or mixed) hydrocarbon flow by a proportional law, adjustable before operation by changing the pre-stress of the spring (35), but not during operation.

FIG. 1 *bis* shows another embodiment of the invention, in which the piston-cylinder assembly for the control of the variable aperture (25) of the central outlet (20) is placed at the level of the male part (22) of this outlet. In this case the rod (23) is motionless and is hollow to be used as a flowline for the control fluid of the central outlet (20). The male part (22) of the central outlet (20) is then sliding on the motionless rod (23) and is pushed by the cylinder (31) and piston (32) assembly under the effect of the pressure of the fluid injected in the volume (33) through the hollow rod (23).

FIG. 2 *bis* is a detailed view of both the outlets and the front end of the flowlines, in the other embodiment of the invention, shown by FIG. 1 *bis*.

FIG. 3 *bis* shows a variant of the simplified embodiment of the invention, in which the spring (35) which controls the variable aperture (25) of the central outlet (20) is placed at the level of this central outlet (20). In this case, the rod (23) is motionless, the male part (22) of the central outlet is sliding on that rod (23) and is directly pushed by the spring (35) locked by a plate (36) on the rod (23).

FIG. 4 shows a more complex embodiment of the invention in which the aperture (65) of the peripheral outlet (60) is continuously adjustable during operation. For this purpose, the nut-screw assembly (40) of FIG. 1 is replaced by a cylinder (41) and piston (42) assembly in the volume (43) of which a pressurized fluid is injected, through a flowline not shown on the figure. The axial motion of the central pipe (12) allows the continuous variation of the aperture (65) during operation.

FIG. 4 *bis* shows a variant of the complex embodiment of the invention in which the aperture (65) of the secondary outlet (60) is continuously variable during operation. For this purpose, the nut-screw assembly (40) of FIG. 1 is replaced by a spring system (44).

What is claimed as my invention is:

1. An apparatus for the burning of hydrocarbons, produced by an oil well, the said apparatus producing a hollow flame, by the means of two concentric, annular and independent outlets, in which:

a first, central, annular outlet is aimed to the spreading of hydrocarbons, this said central outlet having a variable aperture which is the variable spacing between the conical surfaces of two concentric parts, the internal surface of a first female part, fixed at the end of a central pipe aimed to bring the hydrocarbons to the said central outlet, and the external surface of a first male part, fixed at the end of an axial rod, itself maintained along the axis of the said central pipe by a first centring part, both said conical surfaces having substantially the same cone angle, the variation of the said variable spacing is done by the relative axial motion between the said first male and female concentric parts, this said motion being given by a cylinder-piston assembly in which the pressure of a first control fluid, continuously adjustable during the burning, counterbalances the force generated by the hydrocarbons' pressure on the said first male part of the said central outlet, around this said central outlet, a second, peripheral, annular outlet is aimed to the spreading of separated gas, if any, or of compressed air, if necessary, this said peripheral outlet having a variable aperture, which is the variable spacing between the conical surfaces of two concentric parts: the external surface of a second male part, fixed at the end of the said central pipe, and the internal surface of a second female part, fixed at the end of a peripheral pipe maintained concentric around the said central pipe by a second centring part, both said conical surfaces of the said peripheral outlet having substantially the same cone angle as the cone angle of the two said conical surfaces of the said central outlet, the variation of the said spacing between the two said conical surfaces of the said peripheral outlet is done by the relative axial motion between the two said concentric parts of the said peripheral outlet, this said spacing being mechanically adjusted before the burning.

2. The apparatus according to claim 1, characterized by the fact that the axial motion of the said first male part of the said central outlet is not controlled by the said cylinder-piston assembly with the said first control fluid under pressure, but by a return spring (FIG. 3 or 3 *bis*).

3. The apparatus according to claim 1, characterized by the fact that the variable aperture of the said peripheral outlet, given by the axial motion of the said central pipe, is continuously controlled during the burning, the said axial motion of the said central pipe being done by a second cylinder-piston assembly with a second control fluid under pressure (FIG. 4).

4. The apparatus according to claim 1, characterized by the fact that the variable aperture of the said peripheral outlet, given by the axial motion of the said central pipe, is variable during the burning, the said axial motion of the said central pipe being done by a return spring (FIG. 4 *bis*).

* * * * *